US007505701B2

(12) United States Patent
Sanekata et al.

(10) Patent No.: US 7,505,701 B2
(45) Date of Patent: Mar. 17, 2009

(54) THERMOSTAT AND NON-CONTACT TYPE TEMPERATURE SENSOR ARRANGEMENT IN AN IMAGE FORMING APPARATUS

(75) Inventors: Keiji Sanekata, Saitama (JP); Yasuki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 11/393,846

(22) Filed: Mar. 31, 2006

(65) Prior Publication Data

US 2007/0047984 A1 Mar. 1, 2007

(30) Foreign Application Priority Data

Aug. 24, 2005 (JP) ..... 2005-242287

(51) Int. Cl.
*G03G 15/20* (2006.01)

(52) U.S. Cl. ..... 399/33; 399/69

(58) Field of Classification Search ..... 399/33, 399/69, 322, 328, 330, 405
See application file for complete search history.

(56) References Cited

U.S. PATENT DOCUMENTS 6,647,217 B2 * 11/2003 Tomatsu ..... 399/33
6,871,041 B2 * 3/2005 Takagi et al. ..... 399/330
7,299,000 B2 * 11/2007 Taira et al. ..... 399/322

FOREIGN PATENT DOCUMENTS

JP 7-260579 A 10/1995
KR 1020030025853 A 3/2003
KR 1020040063476 A 7/2004

* cited by examiner

*Primary Examiner*—William J Royer
(74) *Attorney, Agent, or Firm*—Sughrue Mion, PLLC

(57) ABSTRACT

An image forming apparatus including a thermostat arranged in a housing of a fixing device with terminals on both ends arranged slanted with respect to a longitudinal direction. A non-contact type temperature sensor is arranged adjacent to the thermostat. Discharge rollers are arranged at equidistance from a center reference line according to a smallest width of paper on a downstream side in a conveying direction of the paper of a housing. A center part of the thermostat and an opening for temperature detection of the temperature sensor are positioned between the discharge rollers.

22 Claims, 10 Drawing Sheets

THERMOSTAT AND NON-CONTACT TYPE TEMPERATURE SENSOR ARRANGEMENT IN AN IMAGE FORMING APPARATUS

CROSS-REFERENCE TO RELATED APPLICATION

This application claims priority under 35 USC 119 from Japanese patent application, No. 2005-242287, the disclosure of which is incorporated by reference herein.

BACKGROUND OF THE INVENTION

1. Field of the Invention

The present invention relates to image forming apparatuses equipped with a fixing device for fixing a toner image transferred to a recording medium, more specifically, relates to an image forming apparatus equipped with a non-contact type temperature detection sensor for detecting the temperature of a heating member and an unusual temperature rise preventing member (thermostat) for preventing unusual overheating of the heating member.

2. Description of the Related Art

In image forming apparatuses such as a copying machine, a printer and the like, an image carrying body such as a photosensitive body is charged, an electrostatic latent image is formed on the surface of the image carrying body by irradiating laser light, and the electrostatic latent image is visualized by a developing device whereby a toner image made up of fine toner particles is formed. After transferring the toner image onto a recording medium such as paper, the toner image on the recording medium is fixed by the fixing device and an image is formed.

The fixing device is provided with a heating roller including a heater inside a rotating body, and a pressure roller for pressurizingly contacting the recording medium to the heating roller. The recording medium formed with the toner image is passed between the heating roller and the pressure roller, so that the toner image is melted from heating and pressurization and is fixed on the recording medium. This fixing device is removable with respect to a main body of the image forming apparatus, and is removed from the main body in replacement due to its life period or in dealing with jam of the recording medium being conveyed.

In such fixing device, a non-contact type temperature sensor for detecting the temperature of the heating roller by means of infrared ray is provided to prevent unusual overheating (unusual temperature rise) of the heating roller. The heater of the heating roller is controlled based on the temperature detected by the non-contact type temperature sensor. Further, a thermostat is arranged at a position facing the heating roller, and the wiring to conduct from a power source to the heater in the heating roller is connected by way of the thermostat. The conduction from the power source is stopped by the thermostat when the heating roller is in an overheated state.

As described in Japanese Patent Application Laid-open No. 7-260579, the non-contact type temperature sensor has a window for the infrared ray to enter, and a resin film having a thermal sensitive element for detecting the infrared ray fixed thereon is arranged at the lower part of the window. A thermal sensitive element for temperature compensation is arranged adjacent to the thermal sensitive element for infrared ray detection by way of a frame body having satisfactory thermal conductivity, and a shielding part for shielding the incidence of the infrared ray is arranged on the upper part of the thermal sensitive element for temperature compensation. In such non-contact type temperature sensor, a potential difference is generated between the thermal sensitive element for infrared ray detection and the thermal sensitive element for temperature compensation according to the infrared ray that has entered from the window. The surrounding temperature is acquired by detecting the amount of infrared ray according to the potential difference.

However, when the recording medium of a small size is conveyed between the heating roller and the pressure roller, the temperature at a region on the heating roller where the recording medium has passed lowers, but the temperature at a region where the recording medium has not passed rises. The non-contact type temperature sensor detects the amount of infrared ray that has entered from the window to acquire the temperature however, it also detects the infrared ray at the periphery of the window. Thus, the temperature of the heating roller may be inaccurately detected due to a temperature difference on the heating roller, which may cause malfunction of the thermostat.

SUMMARY OF THE INVENTION

The present invention provides an image forming apparatus for accurately detecting a temperature of a heating member even if a recording medium of a small size is conveyed between the heating member and a pressurizing member, whereby an unusual temperature rise preventing member is appropriately operated.

A first aspect of the present invention is an image forming apparatus for forming an image according to a center reference position, the image forming apparatus comprising a fixing device for fixing a toner image on a recording medium by a heating member, and a pair of discharge rollers arranged spaced apart from the center reference position by a predetermined distance on a downstream side in a conveying direction of the recording medium from the fixing device. The fixing device includes a non-contact type temperature detection sensor for detecting a temperature of the heating member and an unusual temperature rise preventing member for detecting unusual overheating of the heating member and stopping voltage supply to the heating member, and an opening for temperature detection of the non-contact type temperature detection sensor and the unusual temperature rise preventing member are positioned between the pair of discharge rollers.

A second aspect of the present invention is an image forming apparatus for forming an image according to a center reference, the image forming apparatus comprising a fixing device for fixing a toner image on a recording medium by a heating member, and a feeding tray for accommodating a plurality of recording media and including recording media feeding side guides for guiding both sides of the recording medium in the width direction thereof. The fixing device includes a non-contact type temperature detection sensor for detecting a temperature of the heating member and an unusual temperature rise preventing member for detecting unusual overheating of the heating member and stopping voltage supply to the heating member, and an opening for temperature detection of the non-contact type temperature detection sensor and the unusual temperature rise preventing member are positioned at an inner side with respect to positions at which the recording media feeding side guides are located when a recording medium having a minimum width is fed.

A third aspect of the present invention is an image forming apparatus comprising a fixing device for fixing a toner image on a recording medium by a heating member and an image is formed according to a reference that is defined by assuming a direction horizontally orthogonal to a conveying direction of the recording medium with respect to the heating member is a width direction of the image forming apparatus and providing a predetermined position in the width direction of the image forming apparatus as a reference position. The fixing device includes a non-contact type temperature detection sensor for detecting the temperature of the heating member and an unusual temperature rise preventing member for detecting unusual overheating of the heating member and stopping voltage supply to the heating member, and an opening for temperature detection of the non-contact type temperature detection sensor and the unusual temperature rise preventing member are positioned in an area in the width direction corresponding to the conveying position of the recording medium on the heating member when a recording medium having a minimum width is conveyed in the image forming process.

BRIEF DESCRIPTION OF THE DRAWINGS

Embodiments of the present invention will be described in detail based on the following figures, wherein.

DETAILED DESCRIPTION OF THE INVENTION

One embodiment of the image forming apparatus according to the present invention will now be described based on the drawings.

Figure 1:
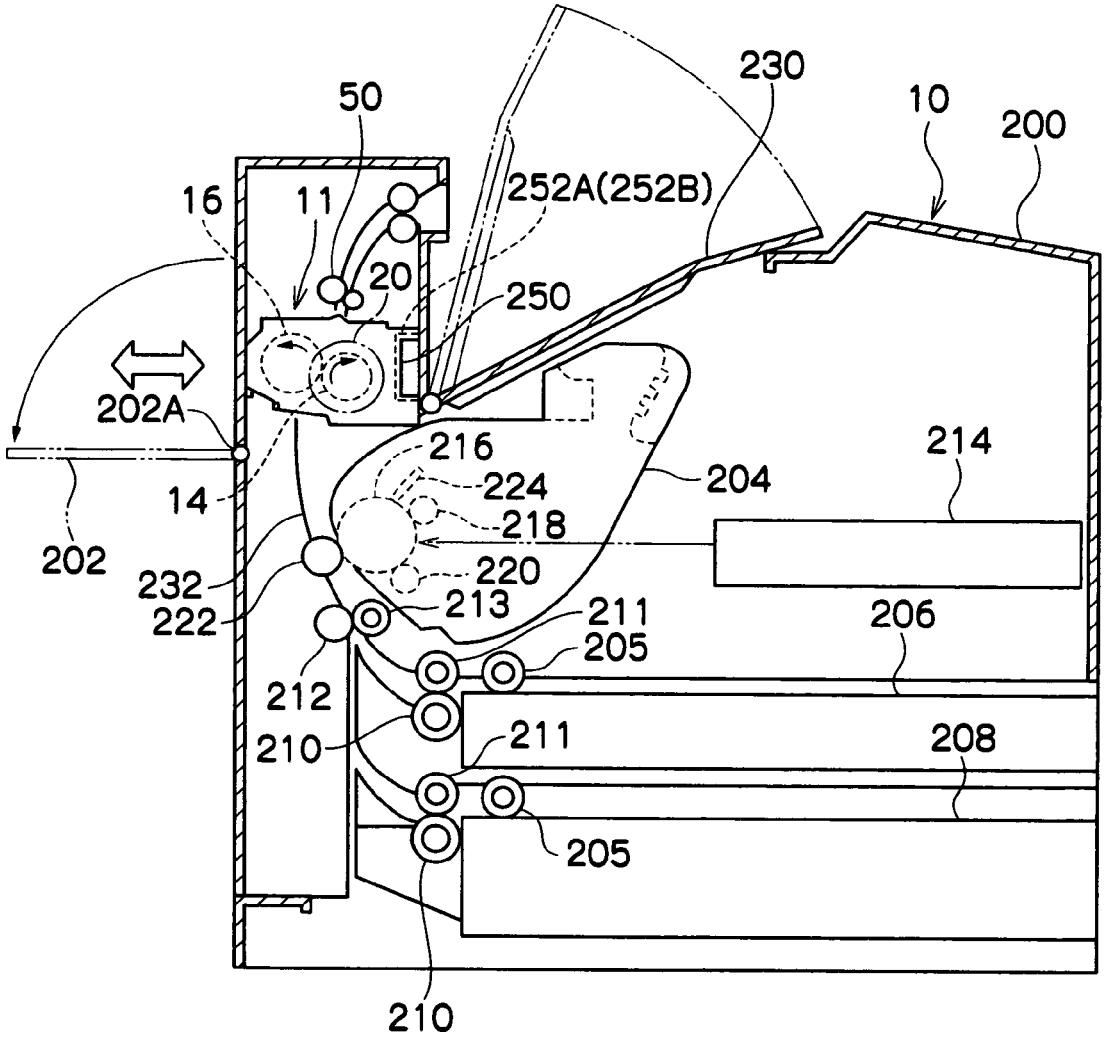
FIG. 1 is a schematic configuration view showing an image forming apparatus according to one embodiment of the present invention.

FIG. 1 shows an image forming apparatus 10 of the first embodiment.

A fixing device 11 consisting of a unit removable with respect to a main body 200 is arranged in the image forming apparatus 10. An opening/closing cover 202 that swings around a supporting shaft 202A is arranged in the main body 200, and the fixing device 11 is installed in the main body 200 by opening the opening/closing cover 202. After the fixing device 11 is installed in the main body 200, a connector 252A of the fixing device 11 is coupled to a connector 252B of the main body 200. The power is then supplied from a power source 250 of the main body 200 to the fixing device 11, and the completion of installation of the fixing device 11 is detected by the image forming apparatus 10. After the fixing device 11 is installed in the main body 200, the image forming apparatus 10 becomes operable by closing the opening/closing cover 202.

Further, a process cartridge 204 unitizing an image forming section is provided in the main body 200. A photosensitive drum 216 that rotates in a constant direction is provided inside the process cartridge 204. A charging roller 218 for charging the photosensitive drum 216, a developing roller 220 for developing an electrostatic latent image formed on the photosensitive drum 216, and a transferring roller 222 for transferring the toner image developed on the photosensitive drum 216 to the paper are arranged on the periphery of the photosensitive drum 216 respectively from the upstream side in drum rotation direction. Further, a cleaning member 224 for cleaning the surface of the photosensitive drum after toner image transfer is arranged at the downstream side from the transferring roller 222 in the rotation direction of the photosensitive drum 216. Moreover, an exposure device 214 for irradiating the imaging light on the photosensitive drum 216 is arranged between the charging roller 218 and the developing roller 220 in the main body 200.

Paper feeding cassettes 206 and 208 for accommodating the papers are arranged at the lower part of the main body 200 and can be pulled out outward. Paper feeding rollers 205 for picking up and conveying one sheet of paper are arranged at paper pick-up positions of the paper feeding cassettes 206 and 208. Further, conveying rollers 210 and 211 and conveying rollers 212 and 213 are arranged for conveying the paper fed from the paper feeding rollers 205 to a section where the photosensitive drum 216 and the transferring roller 222 oppose each other. The fixing device 11 is installed at the downstream side from the transferring roller 222 in the direction of conveying the paper, and further, a paper discharge tray 230 for discharging the paper after toner image fixation is arranged at the downstream side from the fixing device 11. The fixing device 11 is provided to fix the toner image on the paper between a heating roller 14 and a pressure roller 16. The fixing device 11 will be hereinafter described.

In such image forming apparatus 10, the photosensitive drum 216 is charged by the charging roller 218, and an electrostatic latent image is formed on the surface of the photosensitive drum 216 through irradiation of the imaging light from the exposure device 214. The electrostatic latent image is developed by the developing roller 220, and the toner image is formed on the photosensitive drum 216.

The paper is fed from the paper feeding cassette 206 or the paper feeding cassette 208 by the paper feeding roller 205, and conveyed to the section where the photosensitive drum 216 and the transferring roller 222 oppose each other by the conveying rollers 210 and 211 and the conveying rollers 212 and 213. The toner image on the photosensitive drum 216 is transferred onto the paper by the transferring roller 222, and is then heated and pressurized between the heating roller 14 and the pressure roller 16 of the fixing device 11, whereby the toner image is melted and the image is fixed on the paper. Thereafter, the paper with the image formed thereon is discharged to the paper discharge tray 230.

The fixing device 11 will now be explained.

As shown in FIG. 1 and FIG. 2, the fixing device 11 includes a housing 12 of substantially rectangular column shape, and the heating roller 14 and the pressure roller 16 are pivotally supported in a rotating manner in the housing 12. The heating roller 14 and the pressure roller 16 are configured so that the respective peripheral surfaces face each other and are pressure contacted (nipping) with a predetermined pressure. That is, the pressure roller 16 is urged towards the heating roller 14 direction by means of a load spring 18.

Figure 3:
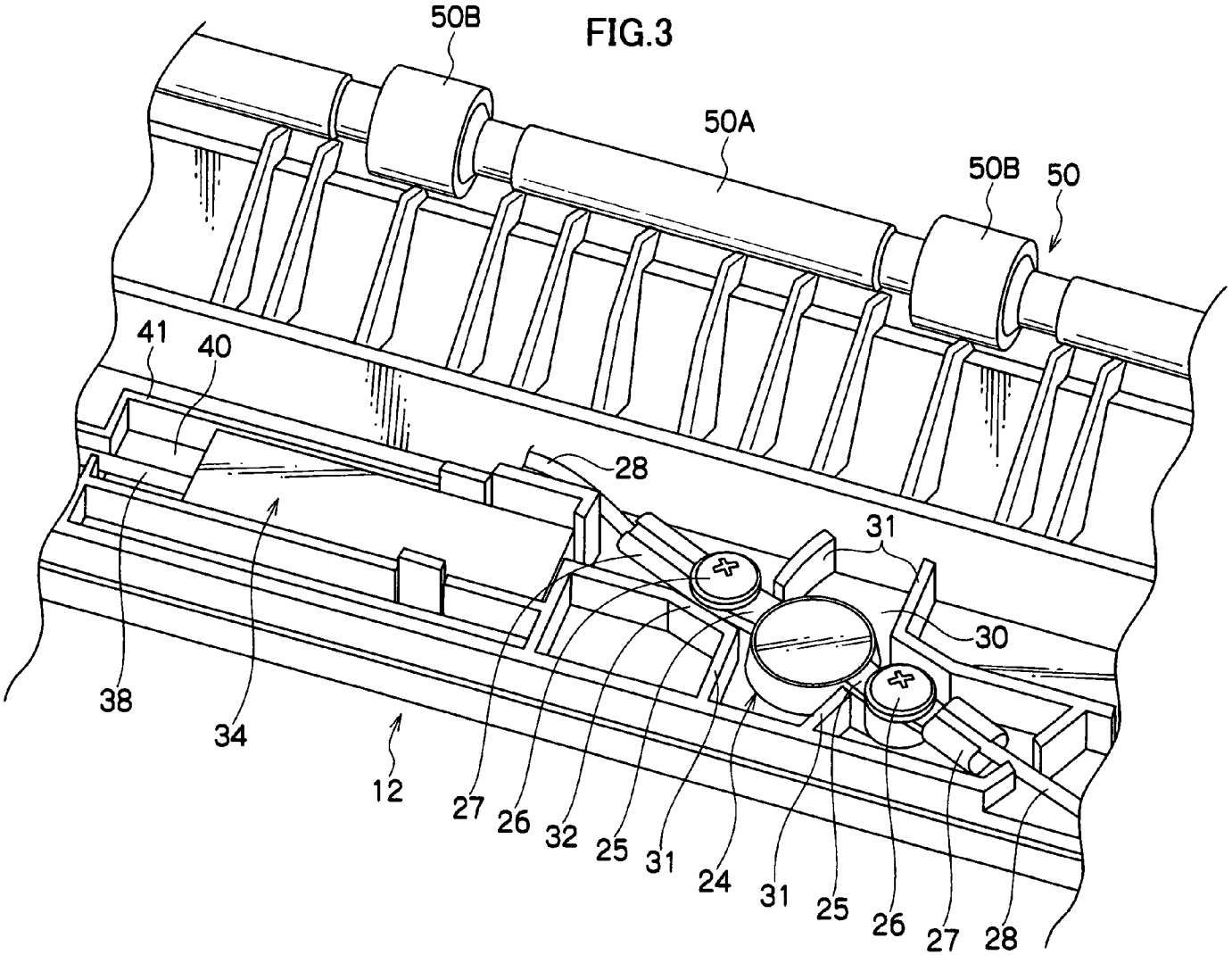
FIG. 3 is a perspective view showing the temperature sensor and a thermostat arranged in the fixing device shown in FIG. 2A.

In the fixing device 11, a carry-in port and a carry-out port for the paper configured by the heating roller 14 and the pressure roller 16 are arranged along the width direction of the fixing device 11. The paper guided through a conveyance path 232 is carried in from the carry-in port, passed through the nip section configured by the heating roller 14 and the pressure roller 16, and carried out from the carry-out port. A pair of discharge rollers 50 for conveying the paper is arranged at the upper part of the carry-out port, as shown in FIG. 1. The discharge rollers 50 are formed by attaching a plurality of rollers 50B around a rotatably driven shaft 50A at a predetermined interval, as shown in FIG. 3.

The heating roller 14 consists of a hollow core (e.g., iron or aluminum rare tube) with a releasing layer (e.g., PFA tube) having a low friction coefficient on a surface layer, and has a heater (not shown) arranged inside. The pressure roller 16 has a heat resistance elastic layer (e.g., silicon sponge, Asker hardness: 40 degrees) arranged around a core made of stainless steel or iron, and a releasing layer (e.g., PFA tube) having a low friction coefficient provided on the surface layer.

The connector 252A of the fixing device 11 is connected to the power source 250 by way of the connector 252B of the main body 200 (refer to FIG. 1), so that the heater of the heating roller 14 heats up to a predetermined temperature thereby melting the toner image on the paper being conveyed.

Figure 2B:
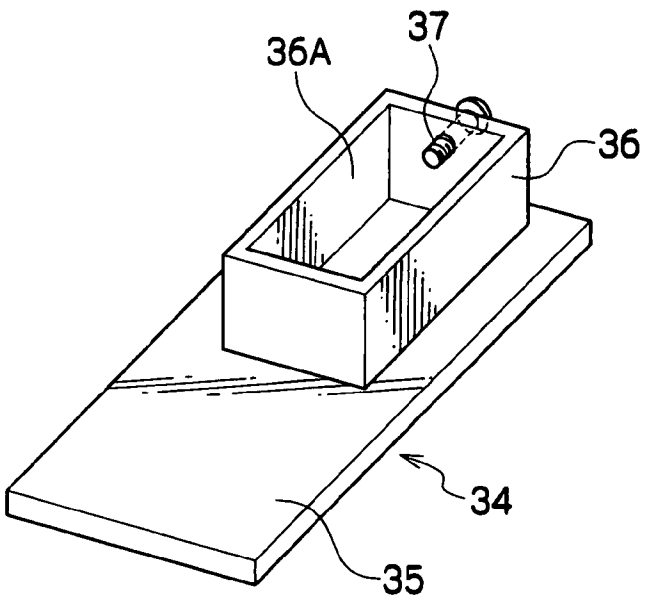
FIG. 2B is a perspective view showing a temperature sensor arranged in the fixing device.
Figure 2A:
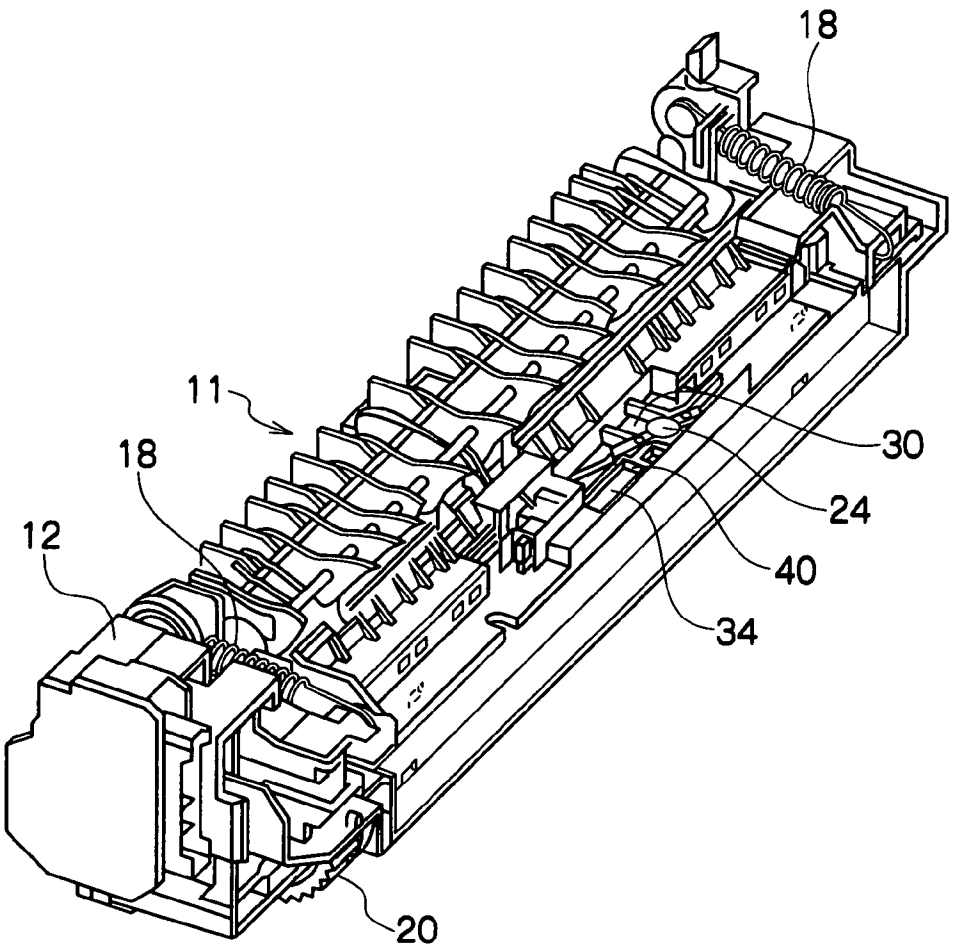
FIG. 2A is a perspective view showing a fixing device used in the image forming apparatus shown in FIG. 1

As shown in FIG. 2A, a driven gear 20 is formed in the fixing device 11, which driven gear 20 meshes with the driving gear (not shown) of the main body 200 to rotate the heating roller 14. The paper is thereby conveyed in a nipped state, and the toner image is fixed on the paper.

Further, as shown in FIG. 2A and FIG. 3, an accommodating recess 30 for accommodating a thermostat 24 is formed on a surface at the upper part of the housing 12. The surface where the accomodating recess 30 is formed locates on the heating roller 14 side rather than the pressure roller 16 side. Further, an accommodating recess 40 for accommodating a non-contact type temperature sensor 34 for detecting the temperature of the heating roller 14 is formed next to the accommodating recess 30 in the width direction of the fixing device 11. The accommodating recess 30 and the accommodating recess 40 are partitioned by a wall 32 bent in a square shape.

As shown in FIG. 3, terminals 25 made of metal are formed on both ends of the thermostat 24, which terminals 25 are fastened to the accommodating recess 30 by metal screws 26. The wirings 28 are caulked and coupled to each terminal 25 with sockets 27. One of the wirings 28 coupled to the terminal 25 is connected to the power source 250 (refer to FIG. 1) by way of the connector 252A of the fixing device 11 and the connector 252B of the main body 200, and the other wiring 28 is connected to the heater (not shown) arranged in the heating roller 14. Thus, electrical conduction occurs from the power source 250 (refer to FIG. 1) to the heater (not shown) arranged in the heating roller 14 through the thermostat 24. When the heating roller 14 is in the overheated state, the thermostat 24 stops the electrical conduction to the heater. The thermostat 24 has the terminals 25 on both ends arranged slanted with respect to an axial direction of the heating roller 14, and the vicinity of the terminal 25 on each end is guided by projections 31 formed in the accommodating recess 30.

As shown in FIG. 2B, the temperature sensor 34 includes a rectangular base 35, and an opening 36A defined by rectangular walls 36 formed on one surface of the base 35. A thermal sensitive element for infrared ray detection (not shown) and a thermal sensitive element for temperature compensation (not shown) are provided at the bottom of the opening 36A. The potential difference is generated between the thermal sensitive element for infrared ray detection (not shown) and the thermal sensitive element for temperature compensation (not shown) due to the infrared ray that has entered from the opening 36A. A temperature is acquired by detecting the amount of infrared ray according to the potential difference. In the walls 36, an adjustment screw 37 is fastened to an open hole formed at one end part of the walls 36 provided in the longitudinal direction of the temperature sensor 34. The adjustment screw 37 is directed in the longitudinal direction of the walls 36. The size of the opening 36A is changed by the fastened position of the adjustment screw 37 to adjust the amount of infrared ray entering the opening 36A.

As shown in FIG. 3, a square guide 41 for guiding the base 35 of the temperature sensor 34 is formed in the accommodating recess 40. An open hole (refer to FIG. 10) in which the opening 36A can be inserted is formed in the accommodating recess 40. The temperature sensor 34 is attached to the accommodating recess 40 by inserting the opening 36A into the open hole. The wiring 38 is connected to the temperature sensor 34 on the side opposite to the thermostat 24.

A circular open hole (refer to FIG. 10) in which the thermostat 24 can be inserted is formed in the accommodating recess 30. The thermostat 24 is inserted into the circular open hole and attached to the accommodating recess 30.

Figure 4A:
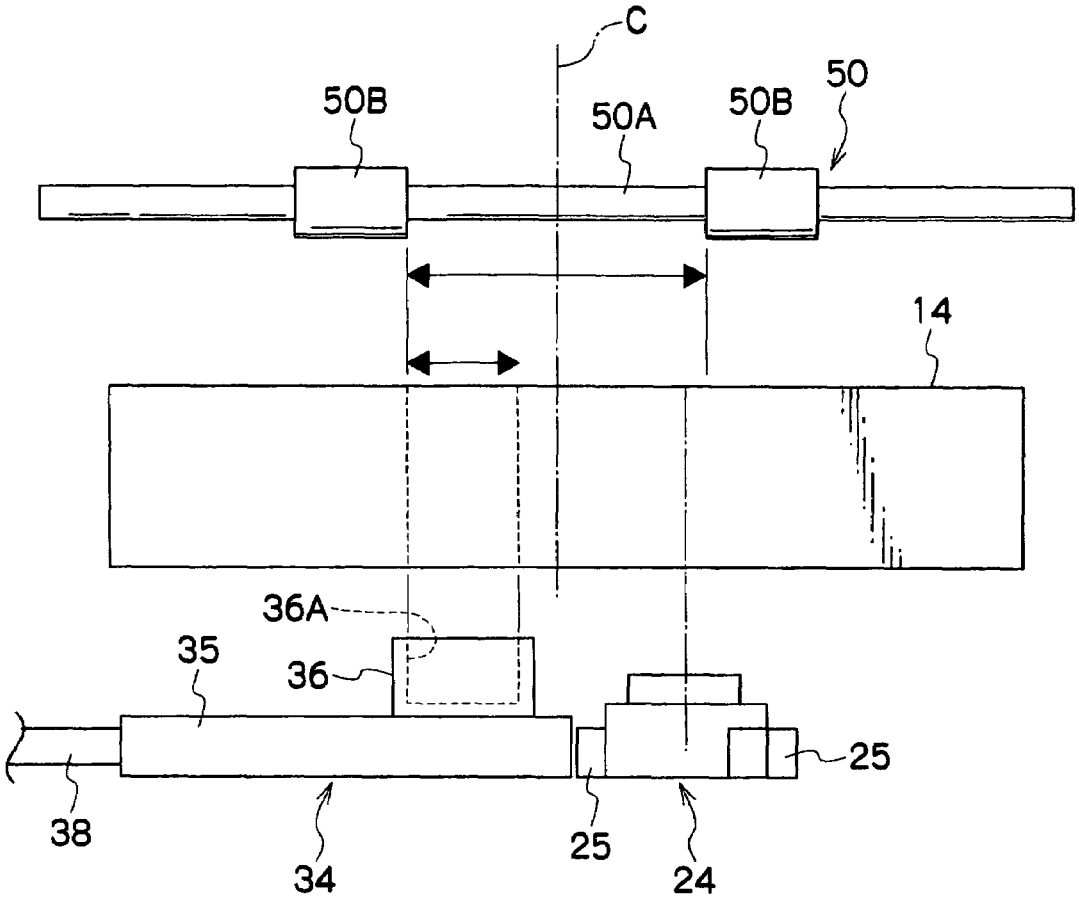
FIG. 4A is a schematic configuration view showing a positional relationship of the temperature sensor and the thermostat with respect to a heating roller and a discharge roller in the image forming apparatus of the present invention.
Figure 4B:
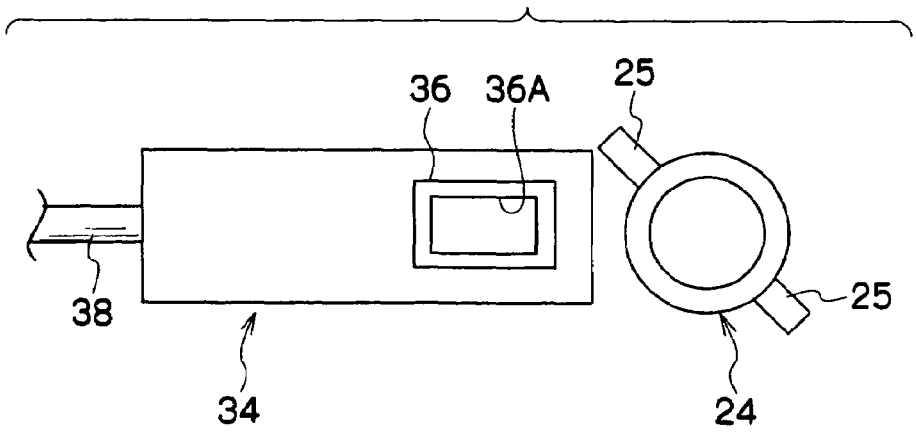
FIG. 4B is a schematic configuration view of the temperature sensor and the thermostat seen from the heating roller side.

FIG. 4 shows a positional relationship of the thermostat 24 and the temperature sensor 34 with respect to the heating roller 14 and the discharge roller 50.

The image forming apparatus 10 is set so as to form an image at a center reference, which is defined by providing a predetermined position in the horizontal direction of the apparatus 10 as the center reference. As shown in FIG. 4A, two rollers 50B configuring the discharge roller 50 are arranged at equidistance from a center reference line C. The two rollers 50B are arranged on the inner side from both ends in the width direction of the paper having a minimum width, and thus the paper of minimum width can be conveyed through the rotation of the rollers 50B. Further, the opening 36A of the temperature sensor 34 and the thermostat 24 are brought closer in the axial direction of the heating roller 14 by arranging the terminals 25 on both ends of the thermostat 24 to be slanted with respect to the axial direction of the heating roller 14, and connecting the wiring 38 of the temperature sensor 34 at the side opposite to the thermostat 24.

Thus, the entire opening 36A of the temperature sensor 34 and the center part of the thermostat 24 are arranged at an inner side with respect to the two rollers SOB (on the center reference side with respect to the position of the two rollers 50B). Thus, when conveying the paper of a small size, the opening 36A of the temperature sensor 34 and the center part of the thermostat 24 are positioned within an area corresponding to a region of the heating roller 14 where the paper is traveled among an entire region of the heating roller 14 in its axial direction. The temperature of the heating roller 14 lowers in the region where the paper is traveled while the temperature of the heating roller 14 rises in the region where the paper is not traveled. However, even when the paper of a small size is conveyed, the opening 36A of the temperature sensor 34 and the thermostat 24 face the region of the heating roller 14 where the temperature lowers due to traveling of the paper. Thus, accurate temperature detection becomes possible with respect to the heating roller 14. In addition, the temperature difference between the opening 36A and the vicinity of the thermostat 24 is maintained small by bringing the opening 36A and the thermostat 24 close, and thus stable temperature detection becomes possible. Accordingly, even when the paper of a small size is conveyed, the thermostat 24 can be appropriately operated and stable fixation of the toner image can be performed.

Figure 5:
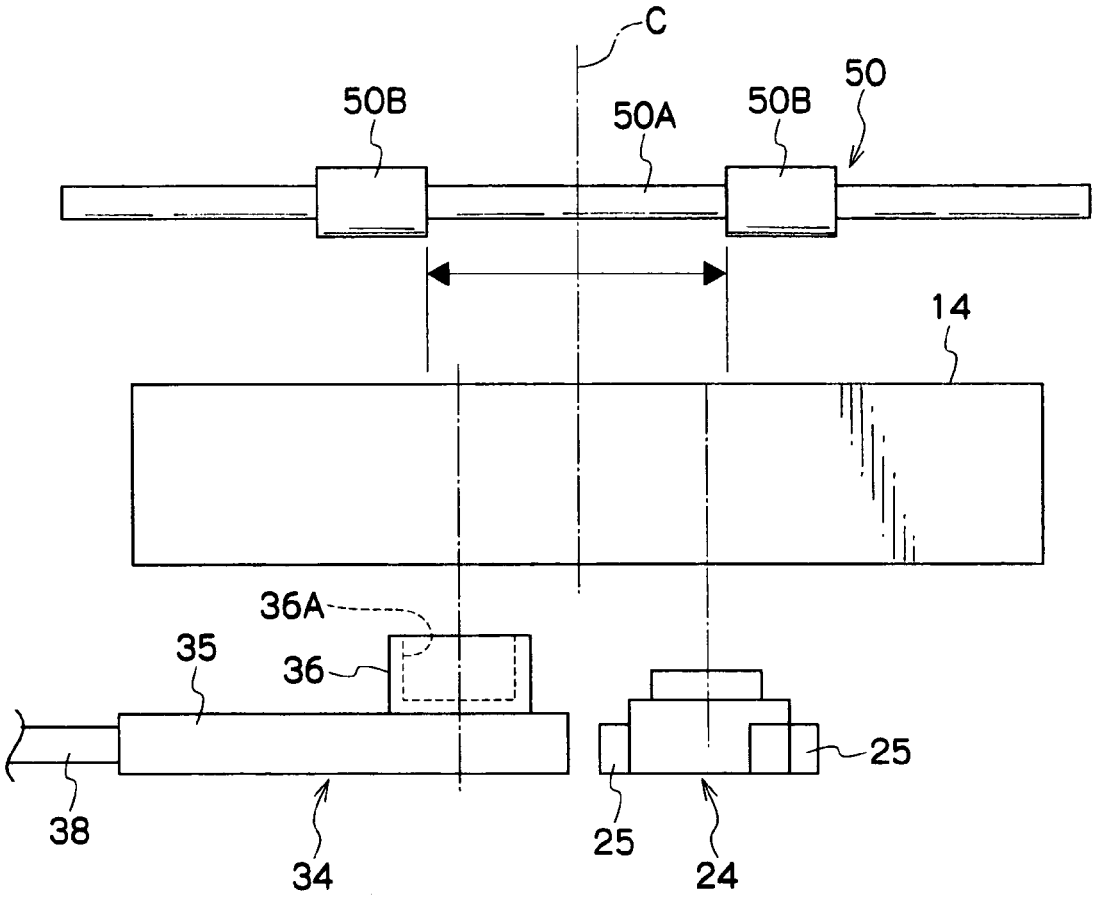
FIG. 5 is another schematic configuration view showing a positional relationship of the temperature sensor and the thermostat with respect to the heating roller and the discharge roller in the image forming apparatus of the present invention.

As shown in FIG. 5, the center part of the opening 36A of the temperature sensor 34 and the center part of the thermostat 24 may be arranged at an inner side with respect to the two rollers 50B (at the center reference side with respect to the position of the two rollers 50B). According to this arrangement, accurate temperature detection can be performed with respect to the heating roller 14 and stable temperature detection can be maintained.

Although not shown, the terminal 25 may be arranged on both ends of the thermostat 24 in a direction orthogonal to the longitudinal direction of the heating roller 14. The temperature sensor 34 and the thermostat 24 can then be further brought closer.

An image forming apparatus according to a second embodiment of the present invention will now be described.

The same reference numerals are denoted for the members the same as those in the first embodiment and explanation will be omitted.

Figure 6:
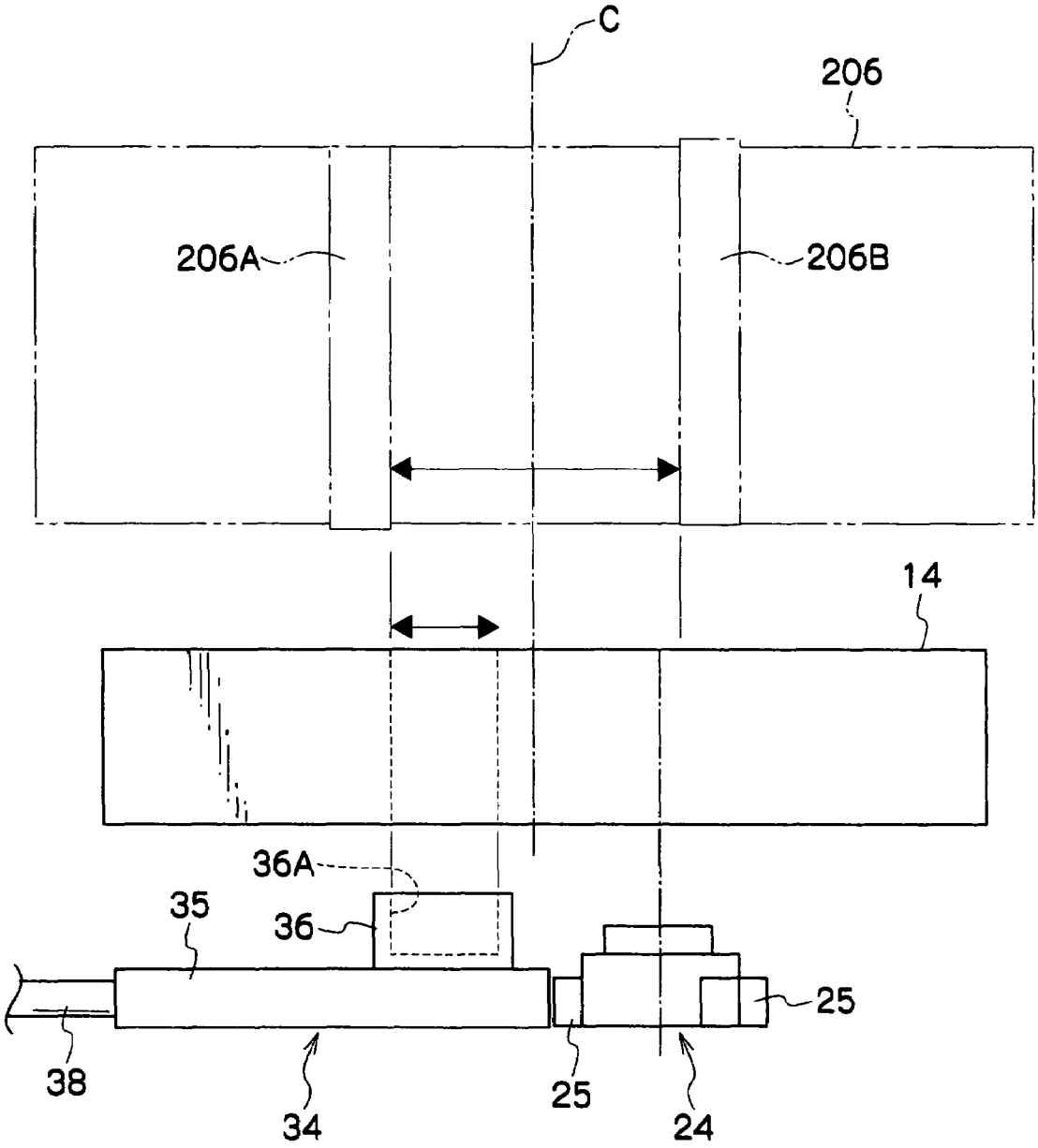
FIG. 6 is a schematic configuration view showing a positional relationship of the temperature sensor and the thermostat with respect to the heating roller and a paper feeding cassette in the image forming apparatus of the present invention.

In FIG. 6, the positional relationship of the thermostat 24 and the temperature sensor 34 with respect to the heating roller 14 and the paper feeding cassette 206 is shown. Paper feeding side guides 206A and 206B for guiding both sides of the paper are arranged in the paper feeding cassette 206. The paper feeding side guides 206A and 206B are arranged at equidistance from a center reference line C, and are slidable in the width direction of the paper feeding cassette 206 (longitudinal direction of the heating roller 14) according to the size of the paper.

The opening 36A and the thermostat 24 are brought close by arranging the terminals 25 on both ends of the thermostat 24 to be slanted with respect to the axial direction of the heating roller 14. The entire opening 36A of the temperature sensor 34 and the center part of the thermostat 24 are arranged at an inner side with respect to the paper feeding side guides 206A and 206B, which are located at positions when the paper having a minimum width is fed. Thus, when conveying the paper of a small size, the opening 36A of the temperature sensor 34 and the center part of the thermostat 24 are positioned within an area corresponding to a region of the heating roller 14 where the paper is traveled among an entire region of the heating roller 14 in its axial direction. Therefore, the accurate temperature detection with respect to the heating roller 14 becomes possible. In addition, the temperature difference between the opening 36A and the vicinity of the thermostat 24 is maintained small by bringing the opening 36A and the thermostat 24 close, and thus stable temperature detection becomes possible. Accordingly, the thermostat 24 is appropriately operated even if the paper of a small size is conveyed and stable fixation of the toner image on the paper is performed.

Although not shown, the center part of the opening 36A may be arranged at the inner side with respect to the paper feeding side guides 206A and 206B, which are located at the positions when the paper having a minimum width is fed. According to this arrangement, accurate temperature detection can be performed with respect to the heating roller 14 and stable temperature detection can be maintained.

An image forming apparatus according to a third embodiment of the present invention will now be described.

The same reference numerals are denoted for the members the same as those in the previous embodiment, and thus explanation will be omitted (same for the embodiments following the third embodiment).

Figure 7B:
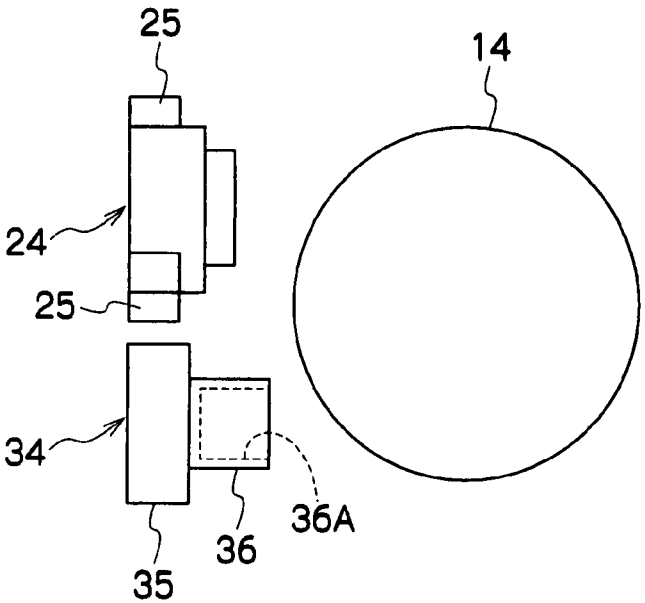
FIGS. 7A and 7B are schematic configuration views showing a positional relationship of the temperature sensor and the thermostat with respect to the heating roller in the image forming apparatus of the present invention.
Figure 7A:
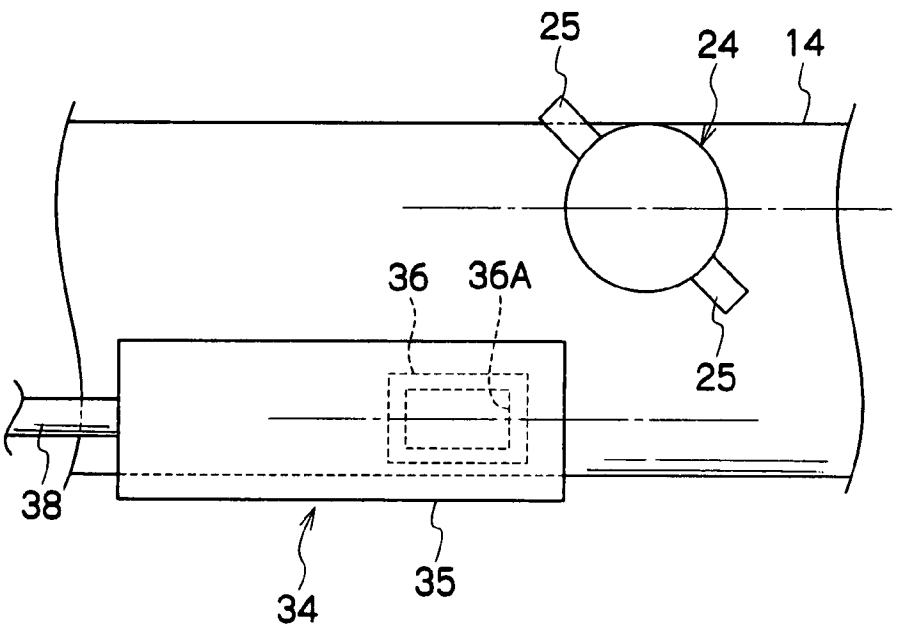

FIG. 7A and FIG. 7B show a positional relationship of the thermostat 24 and the temperature sensor 34 with respect to the heating roller 14. In this embodiment, in a direction orthogonal to the longitudinal direction of the heating roller 14, the center parts of the opening 36A of the temperature sensor 34 and the thermostat 24 are arranged shifted.

Thus, the opening 36A of the temperature sensor 34 and the thermostat 24 can be further brought closer in the axial direction of the heating roller 14, and miniaturization of the fixing device 11 can be realized.

An image forming apparatus according to a fourth embodiment of the present invention will now be described.

Figure 8:
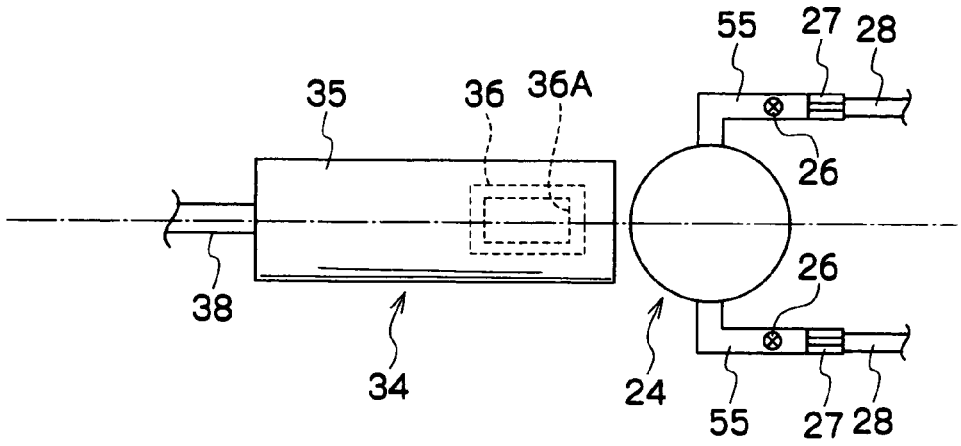
FIG. 8 is a schematic configuration view showing a positional relationship in a longitudinal direction between the temperature sensor and the thermostat in the image forming apparatus of the present invention.

As shown in FIG. 8, the terminals 55 are arranged at both ends of the thermostat 24 in a direction orthogonal to the longitudinal direction (longitudinal direction of the heating roller 14), which each terminals 55 is bent substantially at a right angle in a direction away from the temperature sensor 34. The wiring 28 is connected to each distal end of the bent terminals 55. The opening 36A and the thermostat 24 can thereby be further brought closer in the axial direction of the heating roller 14 (refer to FIG. 1), and miniaturization of the fixing device 11 can be realized.

An image forming apparatus according to a fifth embodiment of the present invention will now be described.

Figure 9B:
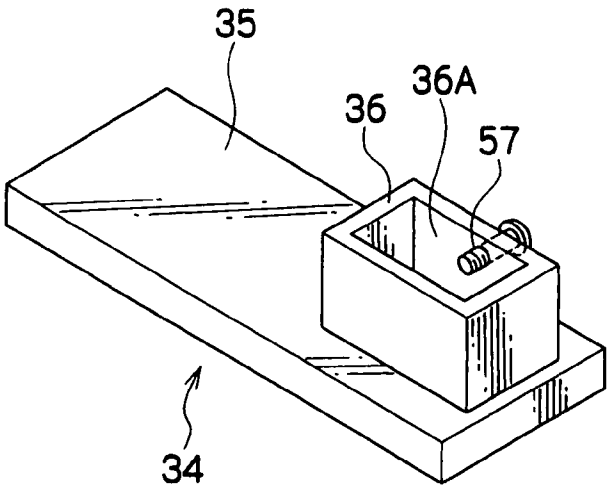
FIG. 9A is a schematic configuration view showing a positional relationship in a longitudinal direction between the temperature sensor and the thermostat in the image forming apparatus of the present invention and FIG. 9B is a perspective view showing the temperature sensor in the image forming apparatus of the present invention.
Figure 9A:
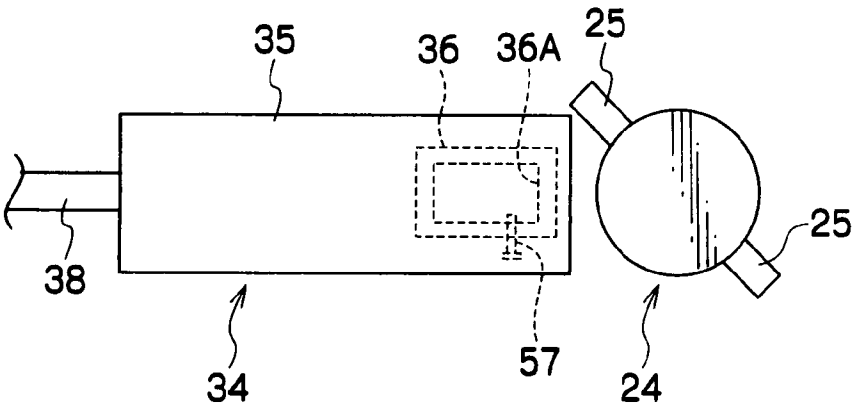

As shown in FIG. 9, an adjustment screw 57 for adjusting the size of the opening 36A is fastened to an open hole of the rectangular wall 36 of the temperature sensor 34, which adjustment screw 57 is directed in a direction orthogonal to the longitudinal direction of the temperature sensor 34. Thus, compared to when the adjustment screw 37 is directed in the longitudinal direction, as shown in FIG. 2, the opening 36A and the thermostat 24 can be further brought closer in the axial direction of the heating roller 14, and miniaturization of the fixating device can be realized.

An image forming apparatus according to a sixth embodiment of the present invention will now be described.

Figure 10:
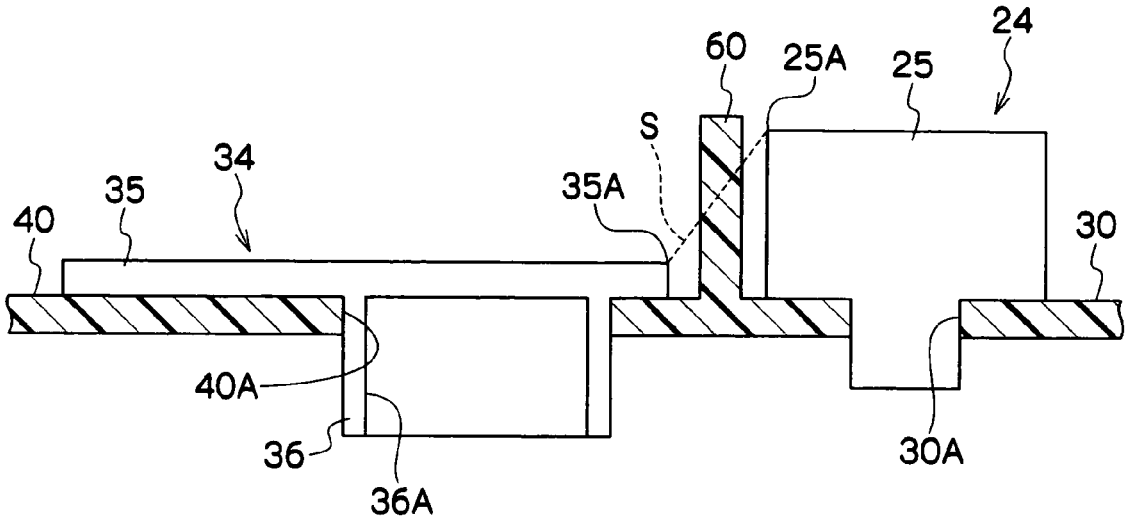
FIG. 10 is a schematic cross sectional view showing a positional relationship in a longitudinal direction between the temperature sensor and the thermostat in the image forming apparatus of the present invention.

As shown in FIG. 10, the opening 36A of the temperature sensor 34 is fitted into an open hole 40A of the accommodating recess 40, and the thermostat 24 is fitted into the open hole 30A of the accommodating recess 30, and an insulating wall 60 is provided between the accommodating recess 40 and the accommodating recess 30. The insulating wall 60 is formed at an opposing section between the temperature sensor 34 and the thermostat 24 and set higher than an imaginable dotted straight line S connecting an upper corner 35A of the end face of the temperature sensor 34 and the upper edge 25A of the terminal 25 of the thermostat 24 facing the upper corner 35A. The lack of distance between the temperature sensor 34 and the thermostat 24 which is caused by bringing them closer and may affect insulation is thus reliably compensated.

The embodiments of the present invention have been explained, but various other embodiments are also possible within the scope of the present invention.

An image forming apparatus of the present invention has an opening for temperature detection of a non-contact type temperature detection sensor and an unusual temperature rise preventing member in a fixing device arranged, in a longitudinal direction of a heating member, at an inner side with respect to a pair of discharge rollers, which are spaced apart from a center reference position by a predetermined distance, or at an inner side with respect to positions where recording medium feeding side guides are located when guiding a recording medium having a minimum width.

According to the above aspects, an image forming apparatus of the present invention has an opening for temperature detection of a non-contact type temperature detection sensor and an unusual temperature rise preventing member in a fixing device arranged in an area corresponding to the conveying position of the recording medium on the heating member when a recording medium having a minimum width is conveyed. Thus, even when conveying the recording medium of a small size, the temperature of the heating member is accurately detected. Therefore, the unusual temperature rise preventing member is appropriately operated and stable fixation of the toner image is performed. Further, the positions of the opening for temperature detection and the unusual temperature rise preventing member are brought close in the axial direction of the heating member, the temperature difference between the non-contact type temperature detection sensor and the vicinity of the unusual temperature rise preventing member is maintained small, and stable temperature detection becomes possible. Therefore, the unusual temperature rise preventing member is appropriately operated and stable fixation of the toner image is performed.

In the above aspects, the non-contact type temperature detection sensor may be arranged so that a center part of the opening for temperature detection is arranged, in a longitudinal direction of a heating member, at the inner side with respect to the discharge rollers or at the inner side with respect to the recording medium feeding side guides.

According to the above, the temperature of the heating member can be accurately detected and the unusual temperature rise preventing member is appropriately operated, thus stable fixation of the toner image is performed.

In the above aspects, terminals at both ends of the unusual temperature rise preventing member may be arranged slanted or orthogonal with respect to the longitudinal direction of the heating member.

In the above aspects, the center part of the opening for temperature detection of the non-contact type temperature detection sensor and the center part of the unusual temperature rise preventing member may be arranged shifted with each other in a circumferential direction of the heating member.

In the above aspects, each terminal at both ends of the unusual temperature rise preventing member may be bent in a direction away from the non-contact type temperature detection sensor.

In the above aspects, wiring of the non-contact type temperature detection sensor may be arranged at a side opposite to the unusual temperature rise preventing member.

According to each of the above aspects, it becomes possible to bring the positions of the opening for temperature detection of the non-contact type temperature detection sensor and the unusual temperature rise preventing member closer in the axial direction of the heating member so that a temperature difference is maintained small between the non-contact type temperature detection sensor and the vicinity of the unusual temperature rise preventing member thereby performing stable temperature detection. Further, the fixing device can be miniaturized.

In the above aspects, an adjustment screw for adjusting the size of the opening for temperature detection of the non-contact type temperature detection sensor is provided, and the adjustment screw may be directed in a direction orthogonal to the longitudinal direction of the heating member.

Thus, compared to when the adjustment screw is directed in the longitudinal direction, the positions of the opening for temperature detection of the non-contact type temperature detection sensor and the unusual temperature rise preventing member can be brought closer in the axial direction of the heating member, stable temperature detection becomes possible, and miniaturization of the fixing device becomes possible.

In the above aspects, the center reference may be determined by assuming a direction horizontally orthogonal to a conveying direction of the recording medium with respect to the heating member is a width direction of the image forming apparatus and providing a predetermined position at the width direction of the image forming apparatus as a reference position for image formation.

In the above aspects, an insulating wall may be arranged between the non-contact type temperature detection sensor and the unusual temperature rise preventing member.

Thus, lack of distance between the non-contact type temperature detection sensor and the unusual temperature rise preventing member which is caused by bringing them closer and may affect insulation is compensated.

Further, the wall, in normal operating state, may be higher in a vertical direction than an imaginary straight line connecting a corner of an end face of the non-contact type temperature detection sensor, that faces the unusual temperature rise preventing member side, and an edge of the terminal of the unusual temperature rise preventing member, that faces the non-contact type temperature detection sensor side.

Thus, the insulation between the non-contact type temperature detection sensor and the unusual temperature rise member is maintained.

According to each of the above aspects, even if the recording medium of a small size is conveyed, the temperature of the heating member is accurately detected, the unusual temperature rise preventing member is appropriately operated and stable fixation of the toner image is performed.

What is claimed is:

1. An image forming apparatus for forming an image at a center reference position, the image forming apparatus comprising:

a fixing device for fixing a toner image on a recording medium by a heating member; and a pair of discharge rollers arranged spaced apart from the center reference position by a predetermined distance on a downstream side, in a conveying direction of the recording medium, from the fixing device; wherein the fixing device includes a non-contact type temperature detection sensor for detecting a temperature of the heating member, and an unusual temperature rise preventing member for detecting unusual overheating of the heating member and stopping voltage supply to the heating member, and an opening for temperature detection of the non-contact type temperature detection sensor and the unusual temperature rise preventing member are positioned between the pair of discharge rollers, wherein the non-contact type temperature detection sensor is arranged so that a center part of the opening for temperature detection thereof is positioned between the pair of discharge rollers.

2. The image forming apparatus of claim 1, wherein terminals on both ends of the unusual temperature rise preventing member are arranged slanted or orthogonal with respect to a longitudinal direction of the heating member.

3. The image forming apparatus of claim 1, wherein the center part of the opening for temperature detection of the non-contact type temperature detection sensor and the center part of the unusual temperature rise preventing member are arranged shifted with respect to each other in a circumferential direction of the heating member.

4. The image forming apparatus of claim 1, wherein terminals on both ends of the unusual temperature rise preventing member are bent in a direction away from the non-contact type temperature detection sensor.

5. The image forming apparatus of claim 1, wherein the non-contact type temperature detection sensor includes an adjustment screw for adjusting the size of the opening for temperature detection, the adjustment screw being directed in a direction orthogonal to the longitudinal direction of the heating member.

6. The image forming apparatus of claim 1, wherein a wiring of the non-contact type temperature detection sensor is arranged at a side opposite to the unusual temperature rise preventing member.

7. The image forming apparatus of claim 1, wherein an insulating wall is arranged between the non-contact type temperature detection sensor and the unusual temperature rise preventing member.

8. The image forming apparatus of claim 7, wherein, in a normal operating state, the insulating wall is higher in a vertical direction than an imaginary straight line connecting a corner of an end face of the non-contact type temperature detection sensor, that faces the unusual temperature rise preventing member side, and an edge of the terminal of the unusual temperature rise preventing member, that faces the non-contact type temperature detection sensor side.

9. The image forming apparatus of claim 1, wherein the center reference position is defined by assuming a direction horizontally orthogonal to a conveying direction of the recording medium with respect to the heating member is a width direction of the image forming apparatus and providing a predetermined position in the width direction of the image forming apparatus as a reference position for image formation.

10. An image forming apparatus for forming an image at a center reference, the image forming apparatus comprising:

a fixing device for fixing a toner image on a recording medium by a heating member; and a feeding tray for accommodating a plurality of recording media and including recording media feeding side guides for guiding both sides of the recording medium in the width direction thereof; wherein the fixing device includes a non-contact type temperature detection sensor for detecting a temperature of the heating member and an unusual temperature rise preventing member for detecting unusual overheating of the heating member and stopping voltage supply to the heating member, and an opening for temperature detection of the non-contact type temperature detection sensor and the unusual temperature rise preventing member are positioned at an inner side with respect to positions at which the recording media feeding side guides are located when a recording medium having a minimum width is fed.

11. The image forming apparatus of claim 10, wherein the non-contact type temperature detection sensor is arranged so that a center part of the opening for temperature detection thereof is positioned at the inner side with respect to the positions at which the recording media feeding side guides are located when the recording media having a minimum width is fed.

12. The image forming apparatus of claim 10, wherein terminals on both ends of the unusual temperature rise preventing member are arranged slanted or orthogonal with respect to a longitudinal direction of the heating member.

13. The image forming apparatus of claim 10, wherein the center part of the opening for temperature detection of the non-contact type temperature detection sensor and the center part of the unusual temperature rise preventing member are arranged shifted with respect to each other in a circumferential direction of the heating member.

14. The image forming apparatus of claim 10, wherein terminals on both ends of the unusual temperature rise preventing member are bent in a direction away from the non-contact type temperature detection sensor.

15. The image forming apparatus of claim 10, wherein the non-contact type temperature detection sensor includes an adjustment screw for adjusting the size of the opening for temperature detection, the adjustment screw being directed in a direction orthogonal to the longitudinal direction of the heating member.

16. The image forming apparatus of claim 10, wherein a wiring of the non-contact type temperature detection sensor is arranged at a side opposite to the unusual temperature rise preventing member.

17. The image forming apparatus of claim 10, wherein an insulating wall is arranged between the non-contact type temperature detection sensor and the unusual temperature rise preventing member.

18. The image forming apparatus of claim 17, wherein, in a normal operating state, the insulating wall is higher in a vertical direction than an imaginary straight line connecting a corner of an end face of the non-contact type temperature detection sensor, that faces the unusual temperature rise preventing member side, and an edge of the terminal of the unusual temperature rise preventing member, that faces the non-contact type temperature detection sensor side.

19. The image forming apparatus of claim 10, wherein the center reference is defined by assuming a direction horizontally orthogonal to a conveying direction of the recording medium with respect to the heating member is a width direction of the image forming apparatus and providing a predetermined position in the width direction of the image forming apparatus as a reference position for image formation.

20. An image forming apparatus comprising a fixing device for fixing a toner image on a recording medium by a heating member, wherein:

an image is formed according to a reference position that is defined by assuming a direction horizontally orthogonal to a conveying direction of the recording medium with respect to the heating member is a width direction of the image forming apparatus and providing a predetermined position in the width direction of the image forming apparatus as the reference position;

the fixing device includes a non-contact type temperature detection sensor for detecting the temperature of the heating member and an unusual temperature rise preventing member for detecting unusual overheating of the heating member and stopping voltage supply to the heating member; and an opening for temperature detection of the non-contact type temperature detection sensor and the unusual temperature rise preventing member are positioned in an area in the width direction corresponding to the conveying position of the recording medium on the heating member when a recording medium having a minimum width is conveyed in an image forming process.

21. The image forming apparatus of claim 20, further comprising a pair of discharge rollers on a downstream side, in the conveying direction of the recording medium, with respect to the fixing device in the image forming process; wherein the opening for temperature detection of the non-contact type temperature detection sensor and the unusual temperature rise preventing member are positioned, in the width direction, at an inner side with respect to the discharge rollers.

22. The image forming apparatus of claim 20, further comprising a recording medium feeding tray for accommodating a plurality of recording media and including recording medium feeding side guides for guiding both sides of the recording medium in the width direction; wherein the opening for temperature detection of the non-contact type temperature detection sensor and the unusual temperature rise preventing member are positioned, in the width direction, at an inner side with respect to positions at which the recording media feeding side guides are located when guiding a recording medium having a minimum width.

* * * * *